United States Patent [19]

Batts et al.

[11] 4,034,865

[45] July 12, 1977

[54] SEGMENTAL ARTICULATED ARTICLE DISPLAY

[75] Inventors: John H. Batts; Judd F. Garrison, both of Grand Rapids, Mich.

[73] Assignee: John Thomas Batts, Inc., Zeeland, Mich.

[21] Appl. No.: 646,183

[22] Filed: Jan. 2, 1976

[51] Int. Cl.[2] ..... A47G 29/00

[52] U.S. Cl. ..... 211/118; 211/113; 224/42.46 A

[58] Field of Search ..... 211/113, 86, 87, 118, 211/116; 224/42, 45 T, 42.46 R, 42.46 A, 42.45 R, 42.45 A, 29 R, 29 C, 45 Q; 24/230.5 FH, 230.5 R; 46/17, 23; 198/177; 40/128; 59/DIG. 001

[56] References Cited

U.S. PATENT DOCUMENTS

| | | | |
|---|---|---|---|
| 485,229 | 11/1892 | Reed | 40/128 |
| 767,236 | 8/1904 | Pilkington | 24/230.5 FH |
| 1,537,788 | 5/1925 | Wentz | 40/128 |
| 1,611,397 | 12/1926 | Wells | 211/113 X |
| 2,039,758 | 5/1936 | Wayne | 211/86 |
| 2,539,891 | 1/1951 | Carr et al. | 59/DIG. 001 |
| 2,593,356 | 4/1952 | Smith | 211/119 |
| 2,737,755 | 3/1956 | Schigas | 59/DIG. 001 |
| 2,742,208 | 4/1956 | Kraft | 223/88 |
| 3,224,596 | 12/1965 | Becker | 211/113 |
| 3,533,495 | 10/1970 | Wallace | 198/177 R X |
| 3,536,286 | 10/1970 | Kramer | 248/339 X |
| 3,584,746 | 6/1971 | Marchman | 211/116 |
| 3,669,276 | 6/1972 | Woods | 211/34 |
| 3,820,195 | 6/1974 | Hutzell | 24/230.5 R X |
| D. 190,608 | 6/1961 | Forrester | D80/8 |

*Primary Examiner*—Roy D. Frazier
*Assistant Examiner*—Robert W. Gibson, Jr.
*Attorney, Agent, or Firm*—Price, Heneveld, Huizenga & Cooper

[57] ABSTRACT

A segmental articulated display arrangement for hook suspended article display devices includes a plurality of links interconnected in a tandem fashion. Each of the individual links includes a rigid body having transversely spaced side members and longitudinally spaced end members interconnecting the side members. A hook-like portion extends outwardly from the body to provide an article support and includes a recess formed on the inner peripheral surface thereof for frictionally receiving the upper end member of another link.

25 Claims, 8 Drawing Figures

SEGMENTAL ARTICULATED ARTICLE DISPLAY

BACKGROUND OF THE INVENTION

This invention relates to display arrangements and more particularly to a unique arrangement for supporting a plurality of hook suspended article display devices in a spaced, vertical relationship.

Various display arrangements have been devised for supporting a plurality of hook suspended display devices in a spaced, vertical relationship. The hook suspended display devices may take the form of garment hangers, carpet hangers, and the like. In displaying these articles, it is highly desirable to space them vertically so that a portion of each article may be shown or is open for viewing. In this manner, various blouses, coats, shirts, pants, etc. having the same design or different designs and colors may be presented for ready comparison by a customer. In a like manner, various designs and colors of carpet samples may be similarly displayed. Further, in the storage or transportation of various garments or other articles, it is highly desirable to support them in the storage or transport area in a spaced, vertical relationship thereby increasing the effective use of the available area.

An example of one arrangement for supporting hook suspended article display devices in a vertical, spaced relationship may be found in copending, commonly owned U.S. patent application Ser. No. 646,178 to John H. Batts, entitled ARTICULATED ARTICLE SUPPORT and filed on even date herewith. The arrangement disclosed therein includes an elongated, flexible tension load supporting strap upon which are slidably mounted a plurality of rigid links. Each link is slotted to fit on the strap and includes a hook extending outwardly from one face thereof. Although substantially alleviating the problems heretofore experienced with such vertical support arrangements, once a device of this nature is assembled, it is possible to increase the number of support points for the article display devices. In other words, the capacity of the device may not be changed at will. Further, a special attachment bracket or a support hook arrangement is required to secure the upper end of the elongated strap to a support surface.

Therefore, a need exists for a display arrangement capable of supporting a plurality of hook suspended devices in a vertically spaced relationship whereby the capacity of the device may be readily increased or decreased at the point of use and whereby the need for special attachment brackets or a support hook arrangement may be obviated. Further, such an improved arrangement would preferably possess the qualities of reduced cost of manufacture, increased ease of manufacture, and increased ease of assembly.

SUMMARY OF THE INVENTION

In accordance with the present invention, a unique articulated article support is provided for hook suspended article display devices whereby the problems heretofore experienced are substantially alleviated. Essentially, the segmental, articulated article support includes a plurality of rigid body links interconnected together so as to extend vertically in a tandem or end-to-end relationship. Each individual link includes a rigid body having transversely spaced side members and longitudinally spaced end members. A hook-like portion extends outwardly from the body in the area of one of the end members. The hook portion includes an inner peripheral surface having a stepped configuration and a recess for frictionally receiving and retaining the end member of the next lower link. Provision is made to limit the lateral rotation of the links with respect to one another. Provision is further made for ready attachment of the uppermost link to a support surface without the need for a separate special bracket arrangement.

DETAILED DESCRIPTION OF THE PREFERRED EMBODIMENT

Figure 1:
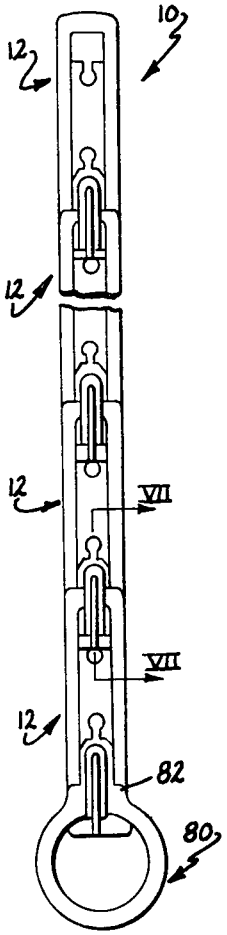
FIG. 1 is a front elevational view of the segmental, articulated article display in accordance with the present invention.

The unique segmental articulated support in accordance with the present invention is illustrated in the drawings and generally designated 10. The support arrangement 10 includes a plurality of individual link members 12 interconnected in an end-to-end or tandem relationship.

Figure 3:
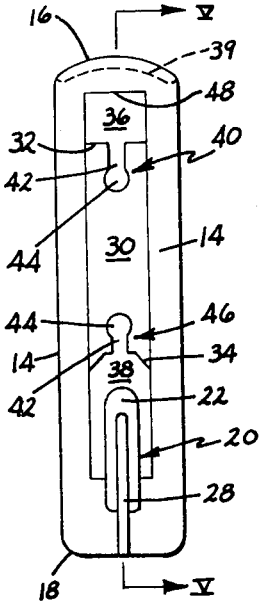
FIG. 3 is an enlarged, front elevational view of one of the individual links employed with the present article display.
Figure 4:
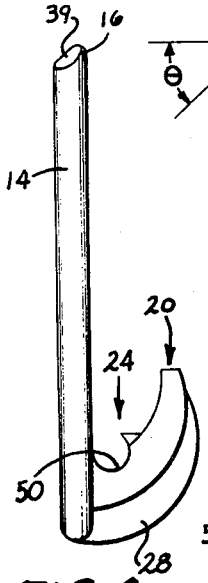
FIG. 4 is a side elevational view of the link of FIG. 3.
Figure 5:
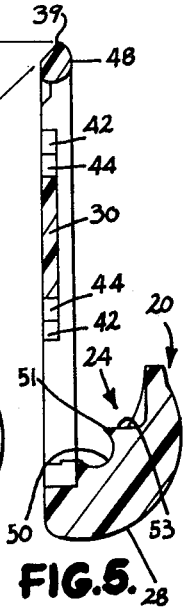
FIG. 5 is a cross-sectional, side elevational view taken generally along line V—V of FIG. 3.

As best seen in FIGS. 3, 4 and 5, each individual link 12 includes a rigid body structure having spaced, parallel side members 14 and transversely extending, longitudinally spaced end members 16, 18. A hook portion 20 extends outwardly from the face of end member 18. The hook portion 20 includes an outer peripheral surface 22, an inner peripheral surface 24, and parallel side surfaces 26. Projecting outwardly from the outer peripheral surface 22 is a centrally positioned, flange-like portion, web-like member, or rib 28. The flange portion 28 is arcuate or generally crescent-like in shape. The rib 28 reinforces the hook. It also has an important secondary function as will be described subsequently.

Each link 12 further includes a web-like, planar portion 30 extending transversely between the side members 14. The transverse edges 32 and 34 of the web 30 are spaced from the end members 16, 18 respectively. The web 30, therefore, in conjunction with the end members and side members, defines an upper aperture 36 and a lower aperture 38. An inverted keyway 40 is formed in the upper end of the web 30. The keyway 40 includes a slot 42 opening into the aperture 36 and a circular opening 44 intersecting with the lower end of the slot 42. Similarly, a keyway 46 is formed in the lower edge of the web 30. The upper end of the keyway 46 also terminates in a circular opening 44. The keyway 46 in like manner opens into the aperture 38. The circular openings 44 provide stress relief by preventing stress concentrations at the ends of the keyway slots.

Figure 2:
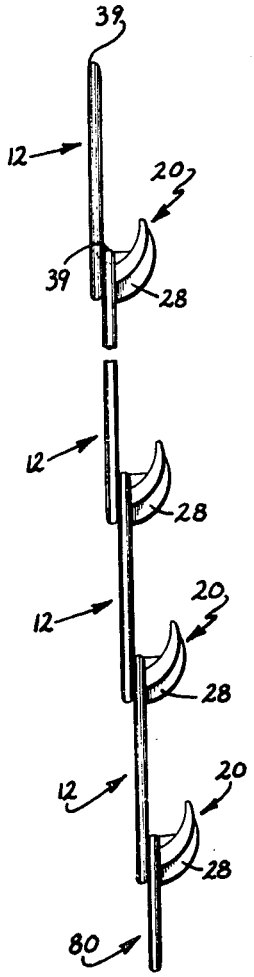
FIG. 2 is a side elevational view of the article display of FIG. 1.
Figure 7:
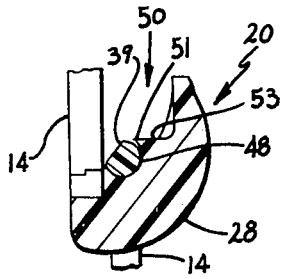
FIG. 7 is a fragmentary, cross-sectional side elevational view taken generally along line VII—VII of FIG. 1.

As best seen in FIGS. 2 and 7, the individual links 12 are interconnected in a chain-like manner by inserting the hook 20 of an upper link through the aperture 36 of the next lower link. The outwardly projecting flange or rib 28 secured to or formed integral with the outer peripheral surface 22 of the hook-like portion is received within the slot 42 of the keyway 40 of the lower link. This structural arrangement greatly increases the resistance to lateral rotation or pivoting of the link members with respect to one another.

The inner peripheral surface 48 of the upper end member 16 (FIG. 5) is rounded or cylindrical in nature. This surface 48 is received within a semi-circular recess or socket 50 formed in the inner peripheral surface of the hook 20, approximately at its point of juncture to the main body of the link. The cylindrical recess 50 acts as a bearing surface which permits limited pivotal movement of the interconnected links. The tip 51 of recess 50 is in effect a continuation of ledge 53 formed in the inner peripheral surface 24 of hook 20. This arrangement restricts entry to the recess or socket 50 and provides a detent type restraint. The detent restraint maintains the links interconnected and firmly retains the end member within the socket during use of the support. As a result, when the lowermost link of the chain is grasped and pulled outwardly away from a vertical or other support surface, the support will assume a curved configuration (FIG. 2) to thereby separate the display articles supported by the hook portions of each individual link. A pull ring 80 including an end portion 82, configured the same as the end portions 16 of each link, may be inserted within the recess 50 of the lowermost link to increase the ease with which the support may be swung outwardly.

In order to increase the stability of the support arrangement when a plurality of garment hangers or the like are suspended therefrom, the outer peripheral surface of each end member 16 is beveled at an angle $\theta$ to a transverse plane passing perpendicular through the end member to define a beveled surface 39 curved along its longitudinal axis. As best seen in FIG. 7, this beveling of the end member results in the curvature of the inner surface 24 of the hook 20 being continued across the top of the end member 16, thus defining a smooth and positive seat for the support hook of the individual hangers. The sloping or beveled surface 39 causes the support hooks of the individual hangers to be biased against the side members 14 of the links under the action of gravity. It is preferred that the angle be a small one. A 20° angle has been found to provide the desired result.

The structural arrangement of the present invention results in a segmental, articulated support whereby a plurality of hook suspended display devices may be supported in a spaced, vertical relationship. The capacity of the support may be readily increased or decreased merely by adding or removing the individual links. Therefore, it can be readily and quickly adapted to the specific requirements of each particular usage. Since the support is segmentized in a chain-like fashion, the ease with which the device may be swung or pivoted outwardly to separate the individual hangers suspended from the support is substantially increased when compared to a device employing a rigid support arm. Therefore, the advantages of the aforementioned articulated support employing a flexible strap member are retained while significant additional advantages are also obtained.

Figure 6:
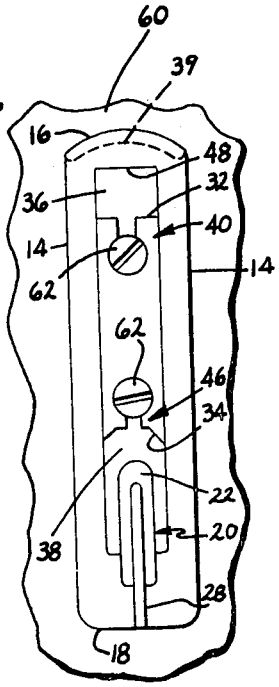
FIG. 6 is a front elevational view showing the manner in which the individual link may be secured to a support surface.

As best seen in FIG. 6, no special bracket arrangement need be provided to secure the segmental support 10 to a vertical support surface 60. As shown therein, the circular openings 44 of the keyways 40, 46 are dimensioned to readily receive detachable fasteners such as screws or the like 62. It is preferred that the web 30 be positioned flush with the lower edge of the side members 14. In this manner, when the uppermost link is secured to a vertical support surface, the weight of the overall device will be spread out over a substantial area. Further, the chances of cracking or breaking the web portion 30 by overtightening the fasteners 62 is substantially reduced.

Figure 8:
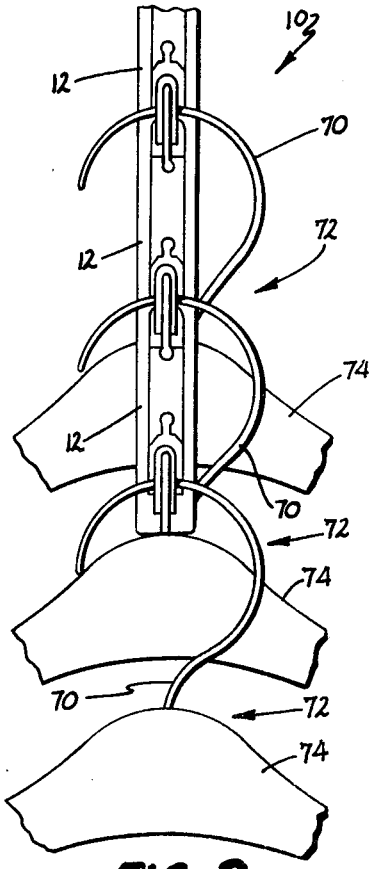
FIG. 8 is a fragmentary, front elevational view of the article display showing the manner in which hook suspended article display devices may be supported therefrom.

As best seen in FIG. 8, when the articulated support has been secured to a support surface, the support hooks 70 of individual display hangers 72 are placed in front of the individual links 72. The hanger portion or support portion 74 is positioned behind the links. Since the links are capable of limited pivotal or rotational movement with respect to each other and further as best seen in FIG. 2 when interconnected, the support assumes a step-like configuration, the device will readily accommodate additional garments.

As previously stated, when the support is swung outwardly from the bottom, the individual garment support will remain vertical and therefore the articles displayed will be separated for ease of removal and placement on the support device. Each article displayed, whether it be a garment, carpet sample, a swatch of wall covering material, or the like, may be viewed by the customer with a short segment of each readily visible. Due to the unique interconnection between adjacent links, the resulting device is fairly rigid and is substantially free from lateral twisting or rotational effects. The arrangement, by permitting vertical spaced support of the individual hangers, increases the capacity of available storage or transport areas. Since links may be easily added, the full area available may be used for storage.

It is preferred that the individual links be molded from a rigid, plastic material having sufficient tensional strength to withstand the forces imposed upon the links during use. It is also important that the material be capable of withstanding long periods under heavy tension loading without significant elongation or other distortion. The material must have high impact resistance. Since this device is intended to be used to display merchandise at the point of sale, it is very important that its appearance neither detract from nor conceal the appearance of the goods being displayed. Therefore, it should be manufactured from a transparent material. Such a material permits the colors of the articles to be seen through the links, and thus the links tend to readily blend into the background of the displayed articles and largely lose their identity. In this way, they do not detract from the merchandise. It has been found that a polycarbonate material meets these specifications. One polycarbonate material which has been successfully used is that sold by Mobay Chemical Company, specification number M-40-1010CL.

Various modifications to the support as illustrated and described will undoubtedly become apparent to those of ordinary skill in the art. For example, the generally rectangular shape of each link may be varied without departing from the inventive concept disclosed. Further, the web portion 30 may extend substantially the entire length of the link body and/or the lower keyway may be changed to a semi-circular opening. Therefore, it is expressly intended that the above description should be considered as that of the preferred embodiment only. The true spirit and scope of the present invention will be determined by reference to the appended claims.

The embodiments of the invention in which an exclusive property or privilege is claimed are defined as follows.

1. A segmental support hook for suspended article display devices including a plurality of interconnected links, each link comprising:

a rigid body having transversely spaced side members and longitudinally spaced end members interconnecting said side members one of said end members being circular in cross sectional throughout a substantial portion of its circumference;

a hook-like portion extending outwardly from said body and having an outer peripheral surface and an inner peripheral surface; and detent means, adjacent the juncture of the inner peripheral surface of said hook-like portion with said body, for securely and pivotally receiving in a detent type fashion said one of the end members of another link, said hook-like portion including means for supporting an article display device.

2. A segmental support for hook suspended article display devices including a plurality of interconnected links, each link comprising:

a rigid body having transversely spaced side members and longitudinally spaced end members interconnecting said side members;

a hook-like portion extending outwardly from said body and having an outer peripheral surface and an inner peripheral surface;

means, a part of said hook-like portion, for securely and pivotally receiving one of the end members of another link; and a web extending transversely between said side members and having a transverse edge spaced from said end member opposite said hook-like portion thereby defining an aperture, said aperture dimensioned so that the hook-like portion of another link may be inserted through said aperture.

3. A segmental support for hook suspended article display devices as defined by claim 2 wherein said hook-like portion of each of said links includes on its outer peripheral surface a projecting flange and wherein said web has a longitudinally extending slot opening into said aperture and dimensioned so as to receive the projecting flange to a connected link whereby the resistance to lateral rotation of each link with respect to another link is increased when the links are interconnected.

4. A segmental support for hook suspended article display devices as defined by claim 2 wherein said web further includes means for receiving a fastener adapted to secure the end link to a support surface.

5. A segmental support for hook suspended article display devices as defined by claim 3 wherein said web further includes means for receiving a fastener adapted to secure the uppermost link to a support surface.

6. A segmental support for hook suspended article display devices as defined by claim 5 wherein said fastener receiving means comprises said web having a generally circular opening intersecting said slot.

7. A segmental support for hook suspended article display devices including a plurality of interconnected links, each link comprising:

a rigid body having transversely spaced side members and longitudinally spaced end members interconnecting said side members;

a hook-like portion extending outwardly from said body and having an outer peripheral surface and an inner peripheral surface;

means, a part of said hook-like portion, for securely and pivotally receiving one of the end members of another link; and wherein said end member receiving means comprises:

said inner peripheral surface of said hook-like portion having a generally stepped configuration including a recess adjacent the area where said hook-like portion mates with said body, said recess dimensioned so as to frictionally retain said end member of another link.

8. A segmental support for hook suspended article display devices as defined by claim 7 wherein said recess has a semi-circular inner peripheral surface and said end member received within said recess has a rounded peripheral surface conforming to the inner peripheral surface of said recess whereby interconnected links may pivot at said recesses when the lowermost link is pulled outwardly.

9. A segmental support for hook suspended article display devices as defined by claim 8 wherein the outer surface of the end member received within said recess is beveled at an angle to a transverse plane passing through said end member thereby defining with said inner peripheral surface of said hook-like portion and said body a pocket for receipt of the article display device hook.

10. A segmental support for hook suspended article display devices as defined by claim 3 wherein said end member receiving means comprises:

said inner peripheral surface of said hook-like portion having a generally stepped configuration including a recess adjacent the area where said hook-like portion mates with said body, said recess dimensioned so as to frictionally retain said end member of another link.

11. A segmental support for hook suspended article display devices as defined by claim 10 wherein said recess has a semi-circular inner peripheral surface and said end member received within said recess has a rounded peripheral surface conforming to the inner peripheral surface of said recess whereby interconnected links may pivot at said recesses when the lowermost link is pulled outwardly.

12. A segmental support for hook suspended article display devices as defined by claim 11 wherein the outer surface of the end member received within said recess is beveled at an angle to a transverse plane passing perpendicular through said end member thereby defining with said inner peripheral surface of said hook-like portion and said body a pocket for receipt of the article display device hook.

13. A segmental support for hook suspended article display devices as defined by claim 12 further including said web having a pair of longitudinally spaced apertures therein each adapted to receive a fastener.

14. A segmental support for hook suspended article display devices as defined by claim 5 further including a pull ring, said pull ring having an end portion securable to the receiving means of the lowermost of the interconnected links.

15. A segmental support for a hook suspended article display as defined by claim 12 further including a pull ring, said pull ring having an end portion, said end portion having a rounded inner peripheral surface conforming to the inner peripheral surface of said recess and receivable within the recess of the lowermost link.

16. A segmental support for a hook suspended article display as defined by claim 15 wherein the outer surface of the ring end portion is beveled at an angle to a transverse plane passing perpendicular through said ring end portion.

17. A link for an articulated article support, said link having a body portion, said body portion having a pair of elongated side members and a pair of end members integral with and joining said side members in spaced relationship; one of said end members being substantially circular in cross section; a forwardly projecting hook at one end of said link; a socket formed in said hook and opening through the inner surface thereof for receiving the substantially circular end member of another link for relative rotational movement in a fore and aft direction; a lengthwise extending web-like member at one end of said link and a lengthwise extending slot adjacent the other end of said links; said web-like member and said slot adapted to cooperate with adjacent links of like construction to align links against lateral pivotal displacement.

18. A link as defined by claim 17 wherein said lengthwise extending web-like member projects outwardly from the outer peripheral face of said hook.

19. A link as defined by claim 18 wherein said web-like member has a half crescent-like shape, the wider portion of the web extending through said slot.

20. A link as defined by claim 19 wherein said link body portion further includes a planar portion extending between said side members and having a fastener receiving aperture.

21. A link for an articulated article support, said link having a body portion, said body portion having a pair of elongated side members and a pair of end members integral with and joining said side members in spaced relationship; one of said end members being substantially circular in cross section; a forwardly projecting hook at one end of said link; a socket formed in said hook and opening through the inner surface thereof for receiving the substantially circular end member of another link for relative rotational movement in a fore and aft direction; means at the entrance to said socket restricting entry to it and for providing a detent type restraint upon the entry into and removal from the socket of the one end member of another link of like construction.

22. A link as defined by claim 21 wherein said detent type restraint means comprises:

said socket having a generally cylindrical inner peripheral surface having an inwardly directed tip portion dimensioned so that the substantially circular end member of another link is retained within said socket.

23. A link as defined by claim 22 wherein the substantially circular end member includes a beveled outer surface sloping downwardly and inwardly at an angle to a plane passing perpendicular through said circular end member.

24. A link as defined by claim 23 wherein said beveled outer surface is curved longitudinally thereof.

25. A link as defined by claim 24 wherein the curvature of said beveled surface conforms to the curvature of a support hook of a garment hanger supported on said surface.

* * * * *

UNITED STATES PATENT AND TRADEMARK OFFICE

CERTIFICATE OF CORRECTION

PATENT NO. : 4,034,865

DATED : July 12, 1977

INVENTOR(S) : John H. Batts and Judd F. Garrison

It is certified that error appears in the above-identified patent and that said Letters Patent are hereby corrected as shown below:

Column 1, line 39:

"possible" should be --impossible--.

Column 4, line 20:

"links 72." should be --links 12--

Column 4, line 38:

"vertical" should be --vertically--.

Column 5, line 53:

"to a" should be --of a--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*